United States Patent [19]

Edwards

[11] Patent Number: 4,838,818

[45] Date of Patent: Jun. 13, 1989

[54] FRICTION STEERING DRIVE SYSTEM FOR ELECTRIC FISHING MOTORS

[75] Inventor: James R. Edwards, Dubuque, Iowa

[73] Assignee: The Eska Company, Dubuque, Iowa

[21] Appl. No.: 886,517

[22] Filed: Jul. 16, 1986

[51] Int. Cl.[4] ..... B63H 21/17

[52] U.S. Cl. ..... 440/6; 114/144 R

[58] Field of Search ..... 440/6, 7, 56, 58, 59, 440/60; 114/154, 144 R, 161, 144 E; 464/30, 42; 188/83; 74/434, 640; 403/373, 375, 344, 362, 290

[56] References Cited

U.S. PATENT DOCUMENTS

| | | | |
|---|---|---|---|
| 558,191 | 4/1896 | Lund | 464/30 |
| 1,851,571 | 3/1932 | Doman | 188/83 |
| 2,545,086 | 3/1951 | Harris | 440/7 |
| 3,307,418 | 3/1967 | Greene | 403/362 |
| 3,511,208 | 5/1970 | Woodruff | 440/7 |
| 3,608,860 | 9/1971 | Horn | 464/30 |
| 4,129,088 | 12/1978 | Foley, Jr. | 440/6 |
| 4,610,632 | 9/1986 | Osborne | 440/6 |
| 4,669,987 | 6/1987 | Schulte | 440/6 |

*Primary Examiner*—Joseph F. Peters, Jr.
*Assistant Examiner*—Edwin L. Swinehart
*Attorney, Agent, or Firm*—James C. Nemmers

[57] ABSTRACT

A friction steering drive system for electric fishing motors of the type customarily used in trolling. These trolling motors commonly have the motor-propeller assembly supported at the lower end of a motor tube that is held by a swivel bracket secured to the mounting assembly of the boat. To steer the boat, the motor-propeller assembly is turned by actuating a steering drive motor that turns the motor tube through a gear train and a friction drive connection between the steering gear and the motor tube.

3 Claims, 2 Drawing Sheets

10
20
34
38
40
32
30
36
24
42
44
22

FRICTION STEERING DRIVE SYSTEM FOR ELECTRIC FISHING MOTORS

BACKGROUND OF THE INVENTION

Most outboard motors, including the electric motors customarily used for trolling, are also used to steer the boat by turning the motor itself. In the case of electric fishing motors, a motor-propeller assembly is supported at the bottom of a motor tube so that turning the motor-propeller assembly will steer the boat. Usually, the steering function is done manually, the units being provided with a control housing at the upper end of the motor tube which has a control handle that is used to control speed and which can also be used to steer the boat. In some instances, the steering function can be performed from a remote location using a cable or linkage system. An example of such a remote steering system is shown in U.S. Pat. No. 4,565,529 issued to Aertker et al. There are obvious disadvantages to the manual system, since the operator must sit near the bow of the boat (if the motor is bow-mounted) and operate the controls. Remote systems such as the one shown and described in the foregoing identified U.S. Patent permit the operator to be located at various positions throughout the boat, and most remote systems utilize foot controls to free the hands of the operator for fishing. However, known remote systems, including those of the type shown in the Aertker et al patent previously referred to, are relatively complicated and require the use of cables or other linkage to turn the motor tube in order to steer the boat.

There is therefore a need for a simple and inexpensive and relatively trouble free steering system for electric fishing motors, especially electric fishing motors that have remote controls either wired or wireless.

SUMMARY OF THE INVENTION

The steering drive system of the invention is designed for electric fishing motors that can be remotely operated by either wireless or wired controls. The drive system of the invention utilizes a steering drive motor and gear train contained within a housing secured to the swivel motor bracket that allows the motor tube to be secured to the mounting assembly of the boat. In other words, the steering drive system is self-contained within a housing that forms a part of the trolling motor unit. The steering drive system housing includes a steering drive motor that drives a steering gear through a suitable gear train. The steering gear turns a drive hub through which the motor tube extends. The drive hub is slotted and is provided with an adjustment knob to vary the friction between the drive hub and the motor tube. Also, the steering gear RPM is adjustable by use of a second friction adjustment knob combined with liners in the bracket through which the motor tube extends. Thus, when the steering drive motor is actuated, it will cause the steering drive gear to turn at a predetermined speed and thus turn the motor tube through the friction drive. By turning the motor tube, the motor-propeller assembly is turned to steer the boat. The drive motor is activated by connection to a receiver which receives its signals from a remote control unit. The motor is also reversible so that the boat can be turned in either direction.

DESCRIPTION OF THE PREFERRED EMBODIMENT OF THE INVENTION

Figure 1:
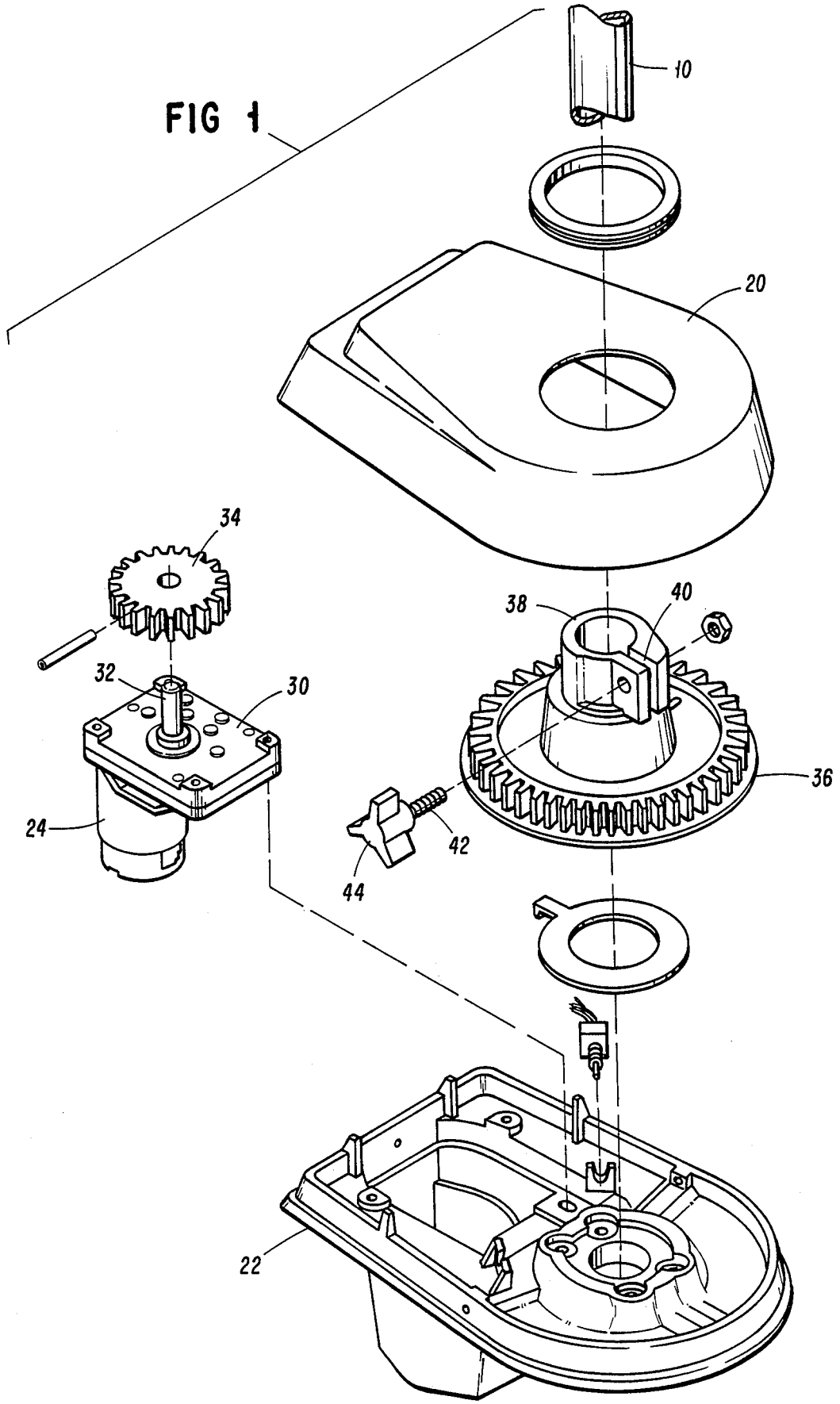
FIG. 1 is an exploded perspective view showing the components of the steering drive mechanism of the invention.
Figure 3:
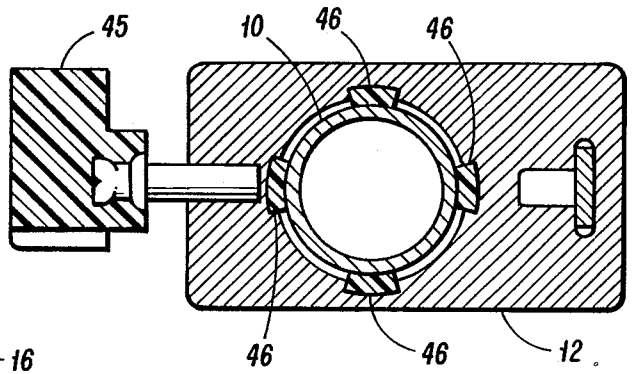
FIG. 3 is a sectional view taken on the line 3—3 of FIG. 2.
Figure 2:
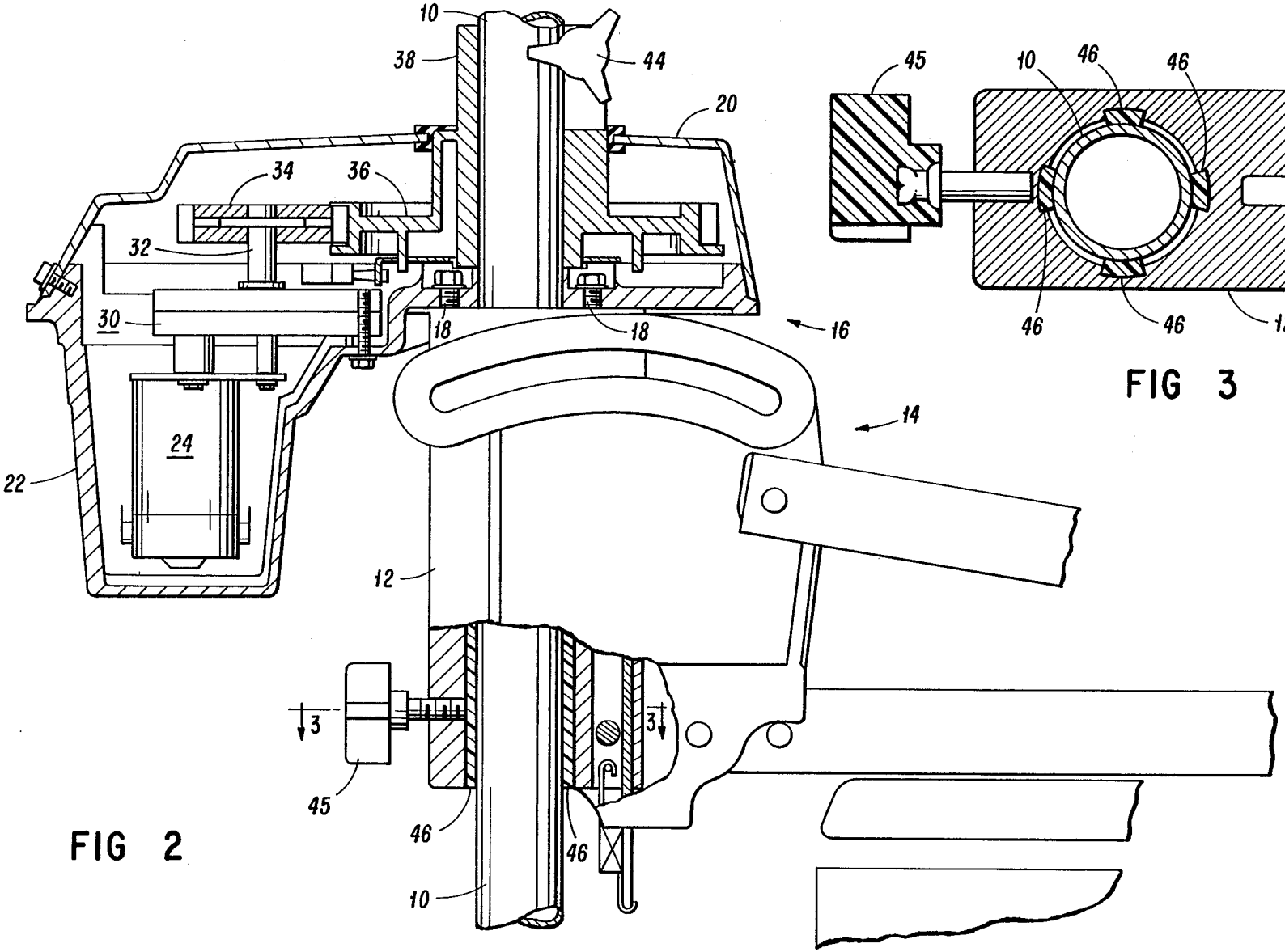
FIG. 2 is a side elevational view, partly in section, showing the components of the steering drive system and the mounting bracket for the motor assembly.

As is well known to those skilled in the art, an electric fishing motor includes a motor-propeller assembly (not shown) positioned at the lower end of a motor tube indicated on the drawings by the reference numeral 10. The motor tube extends vertically through a swivel bracket 12 that is in turn releasably connected to the mounting assembly 14 secured to the boat. A suitable mounting assembly is shown in my co-pending U.S. patent application Ser. No. 884,534, filed July 11, 1986 and entitled "Quick Release Assembly For Electric Troller Motors", now U.S. Pat. No. 4,729,745 Mar. 1988. However, the steering drive system shown and described herein as my invention is not limited in its application to mounting assemblies of that type, but is readily useable with any mounting assembly.

Secured to the top of the swivel bracket 12 is a steering drive housing assembly indicated generally by the reference numeral 16. Housing assembly 16 is secured to the swivel bracket 12 by suitable fasteners such as threaded members 18, and housing assembly 16 preferably includes a removable cover 20 secured to the main housing 22. Preferably, the housing 22 is constructed so as to be water-resistant, and the design illustrated in the drawings is so constructed.

Contained within housing 22 is a steering drive motor 24. This motor is a permanent magnet motor and may be reversible, the motor receiving its power through connection to a storage battery (not shown) that may also be used to power the electric trolling motor although a separate battery may be used. Connection of the drive motor 24 with the storage battery is usually done through a wired connection (not shown) that also contains the control wires carrying the signals to stop, start and reverse the motor 24. A wireless remote control system for accomplishing such control is described in co-pending U.S. patent application Ser. No. 890,009, filed July 24, 1986 and entitled "Wireless Remote Control System For Trolling Motors". However, it should be understood that any suitable control system may be utilized, including wireless and wired remote systems, to control the operation of the steering drive motor 24.

Through a gear box 30, an output shaft 32 is driven which shaft 32 is operatively connected to a small spur gear 34 that is engaged with and drives a larger spur steering gear 36. The speed of the motor 24 and the size and design of the various gears are such that the steering gear 36 is driven at a very low R.P.M. The steering gear R.P.M. is adjustable through use of a friction adjustment knob 43 that is threaded into bracket 12 to engage vertically extending liners 46 which are located on the inside diameter of swivel bracket 12. By tightening friction knob 45, additional frictional force will be created between the liner 46 and the motor tube 10 thereby reducing its R.P.M. and by loosening friction knob 45, the frictional force on the motor tube 10 will be lessened thereby increasing its R.P.M. when driven by steering motor 30. The larger spur gear has a drive hub 38 which is preferably an integral part of the spur gear 36 but which could be a separate drive hub operatively connected to the steering gear 36 so as to be positively driven by it. A belt or chain drive could be used in place of the gear drive to drive hub 38. In any event, the drive hub 38 and spur gear 36 have a central axial opening through them to receive the motor tube 10. The drive hub 38 is slotted as at 40 with the slotted portion 40 having a threaded member 42 extending laterally through it which member 42 has a manual knob at its outer end which when turned will tighten or loosen the grip of the drive hub 38 on the motor tube 10. Thus, when the knob 44 is tightened a sufficient amount, the drive hub 38 will grip the motor tube 10, and sufficient friction between the drive hub 38 and motor tube 10 will permit the motor tube 10 to turn whenever the steering gear 36 is turned by the drive motor 24. Of course, turning the motor tube 10 will also turn the motor-propeller assembly and steer the boat.

Because the connection between the motor tube 10 and the drive hub 38 is a frictional connection only, the motor tube 10 can be positioned relative to the drive hub 38 an infinite number of positions. This serves to provide for quick and easy vertical positioning of the motor-propeler assembly at the desired depth in the water. Thus, by merely loosening the threaded member 42 by turning the knob 44, the grip of the drive hub 38 on the motor tube 10 can be lessened and the motor-propeller assembly moved upwardly or downwardly to the desired position in the water. Upon attaining the desired vertical position of the motor-propeller assembly, the knob 44 can be tightened to obtain the sufficient friction for the friction steering drive.

Moreover, since the connection between the motor tube 10 and the steering drive hub 38 is only because of the friction between them, if the trolling motor should come in contact with a submerged object that would tend to turn the trolling motor, a desired slip of the friction drive will occur between the drive hub 38 and the motor tube 10 to prevent any damage to the motor-propeller assembly.

Thus, the invention provides a simple but positive friction drive system for steering by use of an electric drive motor that can be operated from a remote location. The friction drive also provides for vertical adjustability of the trolling motor at the desired depth in the water. This vertical adjustment is provided quickly and simply. The friction drive also minimizes damage to the trolling motor since it provides a desirable slip between the motor tube and the drive assembly. Having thus described the invention in connection with the preferred embodiment thereof, it will be evident to those skilled in the art that various revisions and modifications can be made to the preferred embodiment described herein without departing from the spirit and scope of the invention. It is my intention however that all such revisions and modifications as are obvious to those skilled in the art will be included within the scope of the following claims.

What is claimed is:

1. A drive system for steering an electric trolling motor for boats in which the motor assembly is supported at the lower end of a vertical motor tube and turnable with the motor tube to steer the boat, said drive system comprising a drive hub adapted to receive and frictionally engage the motor tube, the only connection between the drive hub and motor tube being by reason of the friction between them, an electrically powered steering motor for driving the drive hub, a large gear operatively connected to the drive hub so that the drive hub turns when the large gear turns, a smaller drive gear operatively connected to the steering motor and engaged with the large gear to transmit power from the steering motor to the drive hub and slowly turn the drive hub when the driving motor is actuated thereby turning the motor tube through the frictional connection so as to steer the boat, a support bracket through which the motor tube extends, means for varying the R.P.M. of the motor tube which means includes a vertical liner between the support bracket and the motor tube, and an adjustable knob engageable with the liner to increase the friction force between the liner and the drive tube.

2. A drive system for steering an electric trolling motor for boats in which the motor assembly is supported at the lower end of a vertical motor tube and turnable with the motor tube to steer the boat, said drive system comprising a drive hub having a central circular opening adapted to receive and frictionally engage the motor tube, said hub being a split hub having a slotted portion extending through the periphery of the circular opening to form a pair of outwardly extending flanges, an adjustable member combined with the slotted portion to force the flanges together to vary the effective size of the circular opening so as to vary the frictional force applied to the motor tube by the drive hub, the only connection between the drive hub and motor tube being by reason of the friction between them, an electrically powered steering motor for driving the drive hub, and means operatively interconnecting the drive hub and steering motor to transmit power from the steering motor to the drive hub and slowly turn the drive hub when the driving motor is actuated thereby turning the motor tube through the frictional connection with the drive hub so as to steer the boat, said means including a large driven gear and a smaller drive gear operatively connected to the steering motor, said large driven gear and drive hub being a one-piece structure with the motor tube extending through its center so that the drive hub turns when the large driven gear turns.

3. The drive system of claim 2 in which there is provided a water-resistent housing positioned adjacent to the motor tube, said housing containing the steering motor and the large drive gear and the smaller drive gear.

* * * * *